US011647325B2

(12) United States Patent
Mori

(10) Patent No.: US 11,647,325 B2
(45) Date of Patent: May 9, 2023

(54) HEADPHONES

(71) Applicant: Yamaha Corporation, Shizuoka (JP)

(72) Inventor: Tomoaki Mori, Shizuoka (JP)

(73) Assignee: YAMAHA CORPORATION, Shizuoka (JP)

( * ) Notice: Subject to any disclaimer, the term of this patent is extended or adjusted under 35 U.S.C. 154(b) by 0 days.

(21) Appl. No.: 17/389,236

(22) Filed: Jul. 29, 2021

(65) Prior Publication Data

US 2022/0038812 A1 Feb. 3, 2022

(30) Foreign Application Priority Data

Jul. 31, 2020 (JP) ..... JP2020-129922

(51) Int. Cl.
*H04R 1/28* (2006.01)
*G10K 11/178* (2006.01)
*H04R 1/10* (2006.01)

(52) U.S. Cl.
CPC ..... *H04R 1/2823* (2013.01); *G10K 11/178* (2013.01); *H04R 1/1083* (2013.01); *H04R 2460/01* (2013.01); *H04R 2460/11* (2013.01)

(58) Field of Classification Search
CPC ..... H04R 1/2823; H04R 1/1083; H04R 2460/01; H04R 2460/11; H04R 1/2873; H04R 1/2876; H04R 1/1008; G10K 11/178
See application file for complete search history.

(56) References Cited

U.S. PATENT DOCUMENTS 3,798,393 A * 3/1974 Gorike ..... H04R 1/1008 381/372
5,675,658 A * 10/1997 Brittain ..... H04R 3/002 381/186
8,447,058 B1 * 5/2013 Sung ..... H04R 1/2826 381/373
2002/0015501 A1 * 2/2002 Sapiejewski ..... H04R 1/1083 381/372
2011/0002475 A1 * 1/2011 Kimura ..... H04R 1/1008 2/209
2011/0188696 A1 * 8/2011 Kimura ..... H04R 1/1008 381/378
2016/0150311 A1 * 5/2016 Bremyer ..... H04R 1/1008 381/371
2017/0366894 A1 12/2017 Horbach et al.
2018/0103309 A1 * 4/2018 Ozawa ..... H04R 9/025
2019/0104353 A1 * 4/2019 Ishikawa ..... H04R 1/1008

FOREIGN PATENT DOCUMENTS

JP 6615185 B2 12/2019

* cited by examiner

*Primary Examiner* — Jason R Kurr
(74) *Attorney, Agent, or Firm* — Global IP Counselors, LLP

(57) ABSTRACT

Headphones include a speaker unit, a baffle plate that fixes the speaker unit and includes a bass reflex port disposed therein, an ear pad disposed facing toward the baffle plate, and a sound absorber that is positioned between the baffle plate and the ear pad, and that has a hole facing the bass reflex port.

11 Claims, 4 Drawing Sheets

HEADPHONES

CROSS-REFERENCE TO RELATED APPLICATIONS

This application claims priority to Japanese Patent Application No. 2020-129922, filed on Jul. 31, 2020. The entire disclosure of Japanese Patent Application No. 2020-129922 is hereby incorporated herein by reference.

BACKGROUND

Technical Field

One embodiment of this disclosure relates to headphones.

Background Information

In general, headphones include a speaker unit, a housing, and a baffle plate which serves as a support substrate for the speaker unit.

The headphones of Japanese Patent No. 6615185 disclose a configuration provided with a sheet 134 for suppressing acoustic reflections in the space between the baffle plate and the ear of the user.

SUMMARY

However, the headphones of Japanese Patent No. 6615185 are not provided with a bass reflex port. The headphones of Japanese Patent No. 6615185 cannot suppress resonance of the sound output from the speaker.

The object of one embodiment of this disclosure is to suppress the resonance of the sound output from the speaker in headphones provided with a bass reflex port.

The headphones according to one embodiment of this disclosure comprise a speaker unit, a baffle plate that fixes the speaker unit and includes a bass reflex port disposed therein, an ear pad disposed facing toward the baffle plate, and a sound absorber that is positioned between the baffle plate and the ear pad, and that has a hole facing the bass reflex port.

The headphones according to one embodiment of this disclosure suppress resonance of the sound output from the speaker.

DETAILED DESCRIPTION OF THE EMBODIMENTS

Selected embodiments will now be explained with reference to the drawings. It will be apparent to those skilled in the field from this disclosure that the following descriptions of the embodiments are provided for illustration only and not for the purpose of limiting the invention as defined by the appended claims and their equivalents.

Figure 1:
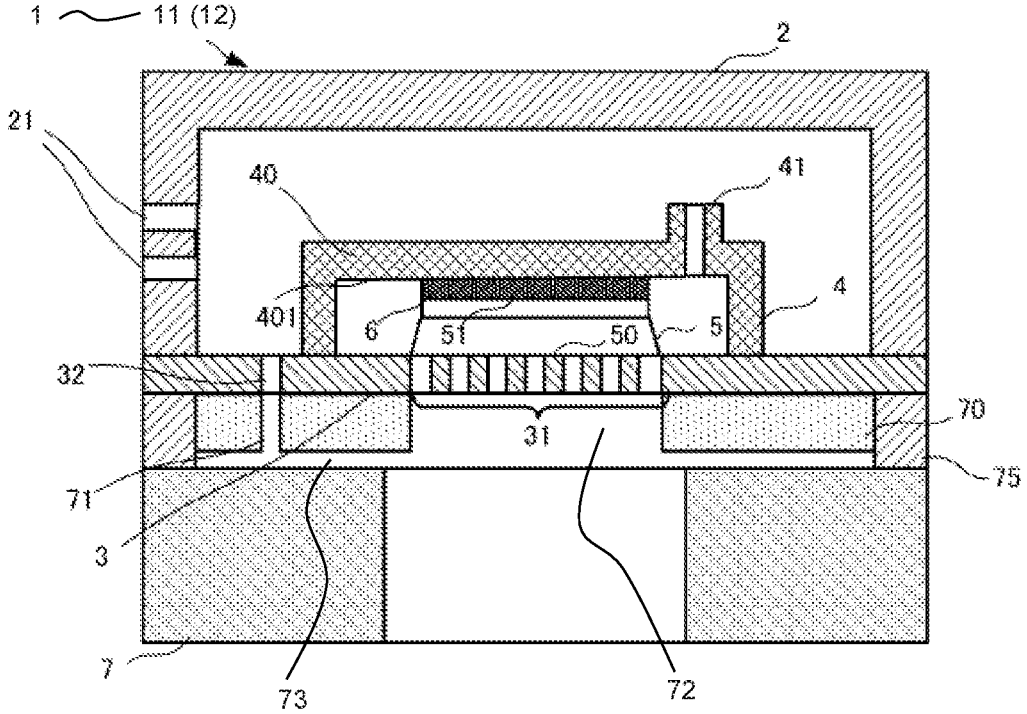
FIG. 1 is a cross-sectional view of a headphone unit.
Figure 2:
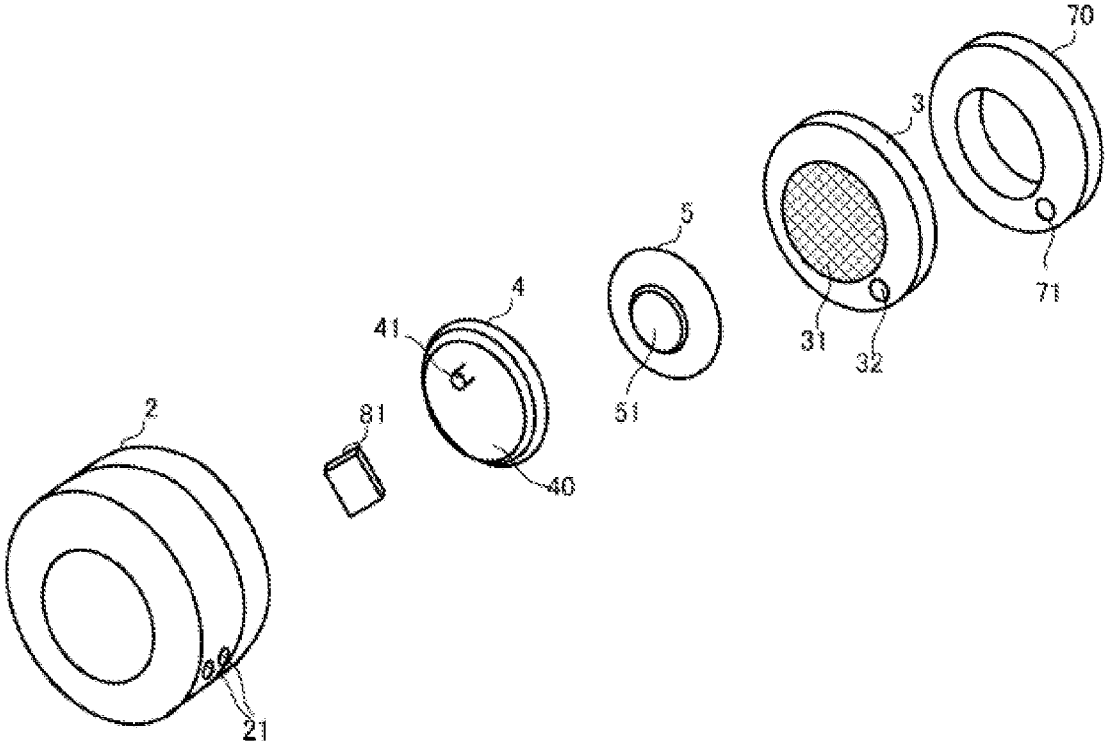
FIG. 2 is a partially exploded perspective view of the headphone unit.

Headphones 1 according to the present embodiment will be described with reference to the drawings. Headphones 1 comprise a left-side headphone unit 11 and a right-side headphone unit 12. The left-side headphone unit 11 and the right-side headphone unit 12 are connected by a headband (not shown). The headphones 1 have the same external appearance as generic headphones, and thus an illustration thereof has been omitted. FIG. 1 is a cross-sectional view of one of the left-side headphone unit 11 and the right-side headphone unit 12. FIG. 2 is an exploded perspective view of the left-side headphone unit 11.

The headphones 1 according to the present embodiment are connected by wire or wirelessly to an audio device, such as a music player, a sound mixer, or a smartphone. The headphones 1 receive audio signals from the audio device, convert the received audio signals into sound, and emit the sound.

The headphones 1 have an active noise cancelling (ANC) function. The headphones 1 according to the present embodiment are configured to boost the sound pressure in the low-frequency range by a bass reflex port using Helmholtz resonance. However, in this disclosure, provision of the ANC function is not essential.

As shown in FIGS. 1 and 2, each of the left-side headphone unit 11 and the right-side headphone unit 12 comprises a housing 2, a baffle plate 3, a chamber 4, a speaker unit 5, an ear pad 7, and a sound absorber (sound-absorbing material) 70. In addition, each of the left-side headphone unit 11 and the right-side headphone unit 12 can further comprise a vibration damper 6 disposed between the speaker unit 5 and the chamber 4. However, the vibration damper 6 can be omitted. Moreover, at least one of the left-side headphone unit 11 and the right-side headphone unit 12 can further comprise a battery 81. The battery 81 is disposed on an outer surface of a bottom wall 40 of the chamber 4.

The left-side headphone unit 11 will be described in detail. The left-side headphone unit 11 and the right-side headphone unit 12 have the same configuration. Therefore, here, the left-side headphone unit 11 will be described as a representative example.

As shown in FIGS. 1 and 2, the housing 2 is in the form of a hollow cylinder with an open first end that faces the baffle plate 3. The speaker unit 5 and the chamber 4 are disposed inside the housing 2. Through-holes 21 are formed in the side wall of the housing 2. The through-holes 21 are provided primarily for conducting air. The housing 2 blocks disturbance noise from the outside. The chamber 4 disposed inside the housing 2 can thus prevent resonance caused by external disturbances.

The baffle plate 3 is disk-shaped. The baffle plate 3 is connected to the housing 2 and covers the open end of the housing 2. That is, the peripheral edge of the baffle plate 3 is connected to the open end of the housing 2. The baffle plate 3 includes a grill 31 formed with a plurality of openings for allowing the sound from the speaker unit 5 to pass through at the center portion facing a sound-emitting part 50 of the speaker unit 5. In addition, the baffle plate 3 includes a first port 32 for bass reflex, and the first port 32 passes through in the thickness direction.

The speaker unit 5 is disposed on the center portion (grill 31) of the baffle plate 3. The speaker unit 5 has an active noise cancelling (ANC) function.

The chamber 4 is arranged in the space formed by the housing 2 and the baffle plate 3. The chamber 4 is in the form of a hollow cylinder with an open first end on the baffle plate 3 side. The open end of the chamber 4 is connected to the baffle plate 3. That is, the baffle plate 3 is disposed to cover the open end of the chamber 4. The chamber 4 contains the speaker unit 5. The chamber 4 is disposed to cover the outer circumferential surface and rear surface 51 of the speaker unit 5. More specifically, the chamber 4 is disposed such that an inner surface 401 of a bottom wall 40 and the rear surface 51 of the speaker unit 5 face each other. The chamber 4 also has the function of insulating the sound of the speaker unit 5.

The chamber 4 has a second port 41 that is formed on the bottom wall 40 for bass reflex. The second port 41 is in the form of a cylinder with two open ends and projects toward the outer side of the bottom wall 40. In this case, the speaker unit 5 is disposed inside the chamber 4 so as not to block the opening of the second port 41.

The internal spaces of the chamber 4 and the housing 2 communicate with each other through the second port 41. As a result, the chamber 4 and the housing 2 function as the cavity of a Helmholtz resonator. Thus, the second port 41 and the first port 32 function as resonance tubes.

The ear pad 7 is provided on the baffle plate 3 side, opposite the side on which the speaker unit 5 is disposed. The ear pad 7 is cylindrical in form. The central portion of the ear pad 7 is open, so that sound emitted from the sound-emitting part 50 of the speaker unit 5 reaches the outside (i.e., the ear of the user). The ear pad 7 is connected to the baffle plate 3 via cylindrical base material 75 at the peripheral edges. A space corresponding to the thickness of the base material 75 is formed between the ear pad 7 and the baffle plate 3. The sound absorber 70 is disposed between the baffle plate 3 and the car pad 7, filling the space. The sound absorber 70 is made up of porous material, such as glass wool, felt, or urethane. The sound absorber 70 prevents sounds output from the speaker unit 5 from being reflected and interfering with each other in the space.

The sound absorber 70 is cylindrically formed. The central portion of the sound absorber 70 is open, so that the sound emitted from the sound-emitting part 50 of the speaker unit 5 reaches the ear of the user. The sound absorber 70 has a central opening 72 (opening) at a position facing toward the speaker unit 5. The central opening 72 corresponds to the opening of this disclosure. The area of the central opening 72 is the same as the area of the front surface of the speaker unit 5.

The sound absorber 70 also has an opening 71 (hole) at the position facing the first port 32. The opening 71 corresponds to the hole of this disclosure. The diameter of the opening 71 is preferably the same as the diameter of the first port 32 or larger than the diameter of the first port 32. In addition, the sound absorber 70 is attached to the baffle plate 3, and the sound absorber 70 and the ear pad 7 are at least partially spaced apart from each other with a gap therebetween. In this embodiment, there is a gap 73 that is entirely arranged between the sound absorber 70 and the ear pad 7 in the vertical direction as viewed in FIG. 1. The resonance sound output from the first port 32 reaches the central opening of the ear pad 7 through the opening 71 and the gap 73, and reaches the ear of the user.

The sound absorber 70 thereby prevents interference of the sound output from the speaker unit 5 and causes the resonance sound output from the first port 32 to reach the ear of the user. The thickness of the gap 73, which is the thickness between the sound absorber 70 and the ear pad 7 in the vertical direction as viewed in FIG. 1, is preferably larger than the diameter of the first port 32 which is the bass reflex port. If the thickness of the gap 73 is less than or equal to the diameter of the first port 32, the gap 73 can also function as a bass reflex port. In this case, the resonance frequency takes on a value that differs from the design, and the sound quality can differ from the target sound quality. If the thickness of the gap 73 is greater than the diameter of the first port 32, the gap 73 does not function as a bass reflex port, so that the desired sound quality can be reproduced. In the present embodiment, the first port 32 has a circular cross section, but the cross-sectional shape of the bass reflex port need not be circular. For example, the cross-sectional shape of the bass reflex port can be elliptical or polygonal. Even when the cross-sectional shape of the bass reflex port is elliptical, the thickness of the gap 73 is preferably larger than the diameter (length of the major axis). Even when the cross-sectional shape of the bass reflex port is polygonal, the thickness of the gap 73 is preferably greater than the diameter of the bass reflex port (the length of longest diagonal).

Figure 3A:
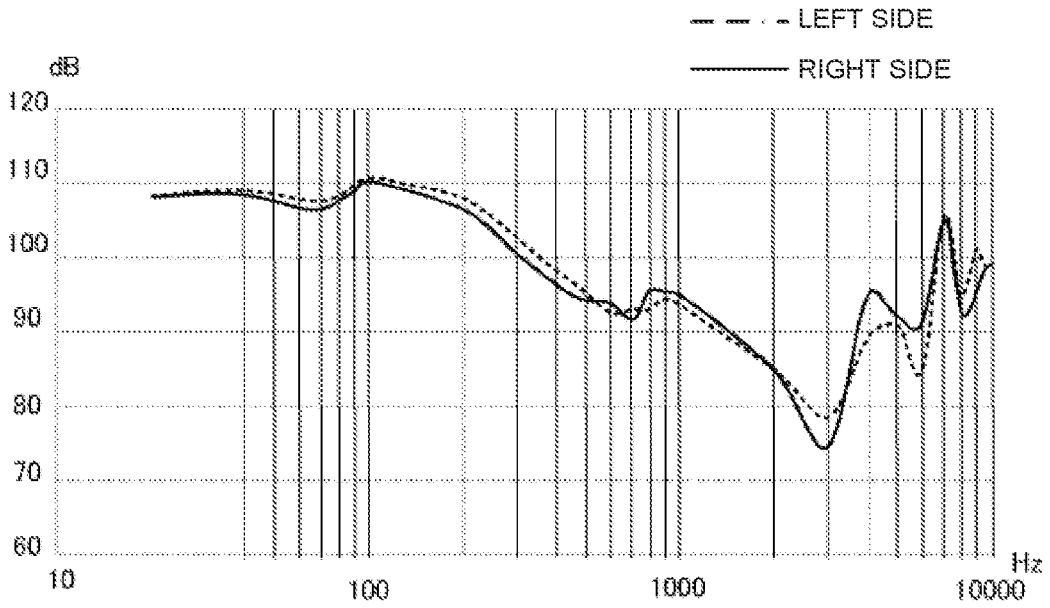
FIG. 3A is an explanatory diagram showing a reference example of frequency characteristics of headphones not provided with a sound absorber.
Figure 3B:
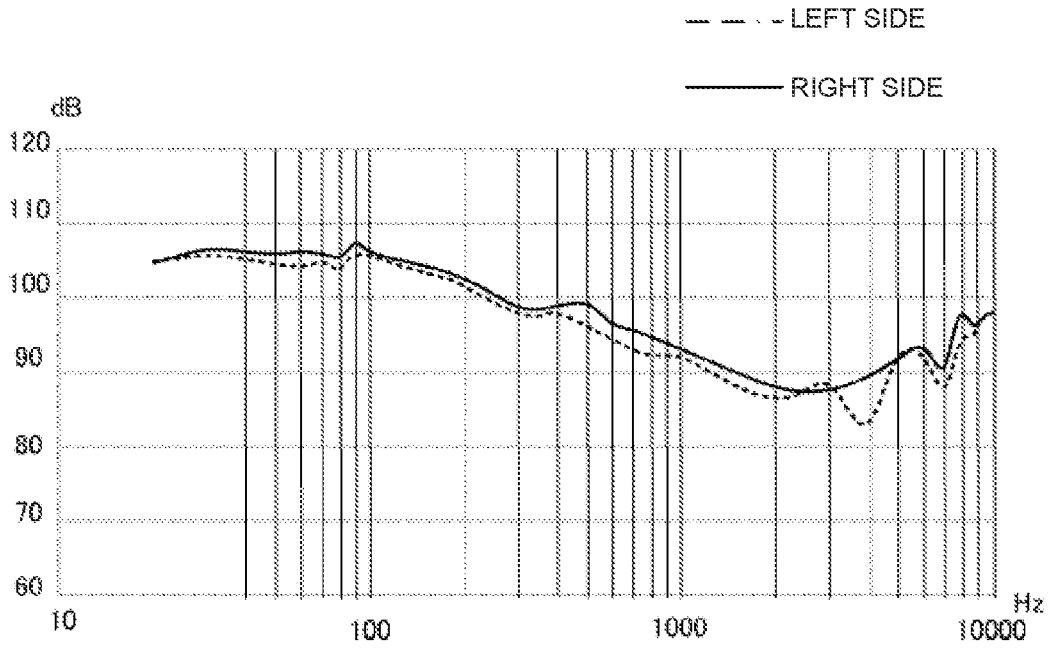
FIG. 3B is an explanatory diagram showing one example of frequency characteristics of headphones provided with a sound absorber.

FIG. 3A is an explanatory diagram showing an example of the frequency characteristics of the left-side headphone unit and the right-side headphone unit in which the sound absorber 70 is not provided as a reference example. Aside from the presence/absence of the sound absorber 70, the reference headphones have the same configuration as the headphones 1 of the present embodiment. FIG. 3B is an explanatory diagram showing an example of the frequency characteristics of the left-side headphone unit 11 and the right-side headphone unit 12 of the present embodiment provided with the sound absorber 70.

As shown in FIG. 3A, the frequency characteristics of the left-side headphone unit and right-side headphone unit of the reference example include numerous dips (minimal components), particularly in the upper midrange (2 kHz-10 kHz). These dips are caused by the reflections and interference of the output sound of the speaker unit 5 between the baffle plate 3 and the ear pad 7.

In the headphones 1 of the present embodiment, on the other hand, the sound absorber 70 is disposed between the baffle plate 3 and the ear pad 7 in order to suppress interference. Therefore, as shown in FIG. 3B, in the headphones 1 of the present embodiment, dips are suppressed in the upper midrange. More specifically, in the headphones 1 of the present embodiment, the large 3-kHz dip of the reference example is almost gone. In contrast, due to the presence of the gap 73 between the opening 71 and the ear pad 7, the sound absorber 70 does not obstruct the resonance sound output from the first port 32, and the frequency characteristics in the lower midrange below 1 kHz are not deteriorated. Further, by the configuration of the present embodiment, the frequency characteristics in the lower midrange below 1 kHz become flatter. Since the headphones 1 of the present embodiment do not add extraneous frequency characteristics to the input sound in the lower midrange below 1 kHz, sound closer to the original sound can be output.

Thus, the headphones 1 of the present embodiment can improve the sound quality by the sound absorber 70.

Figure 4A:
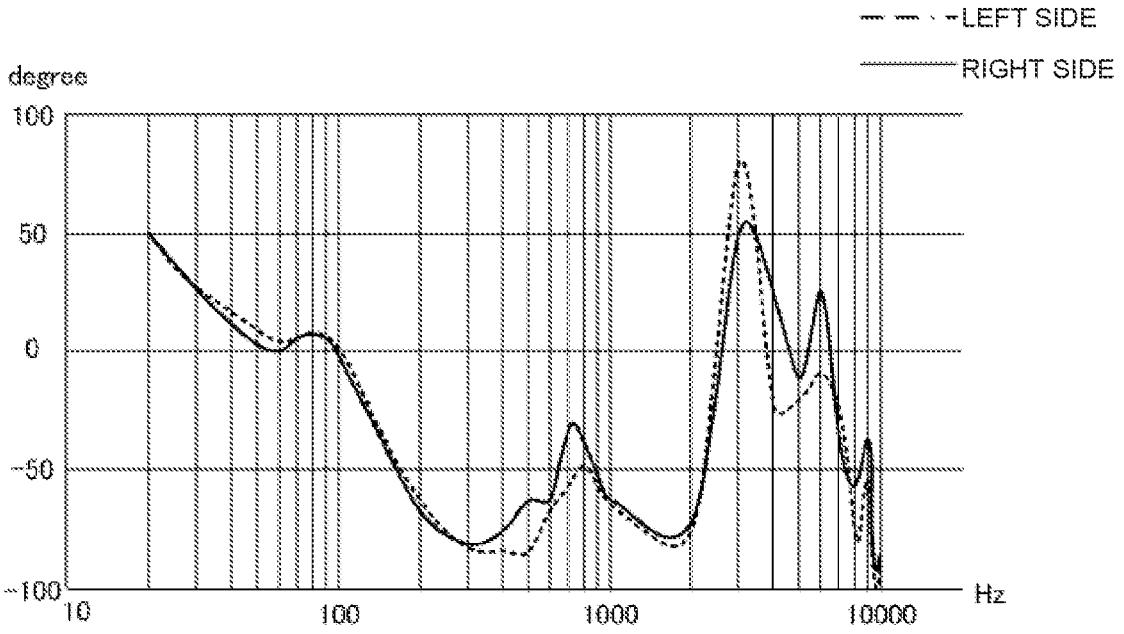
FIG. 4A is an explanatory diagram showing a reference example of phase characteristics of the headphones not provided with the sound absorber.
Figure 4B:
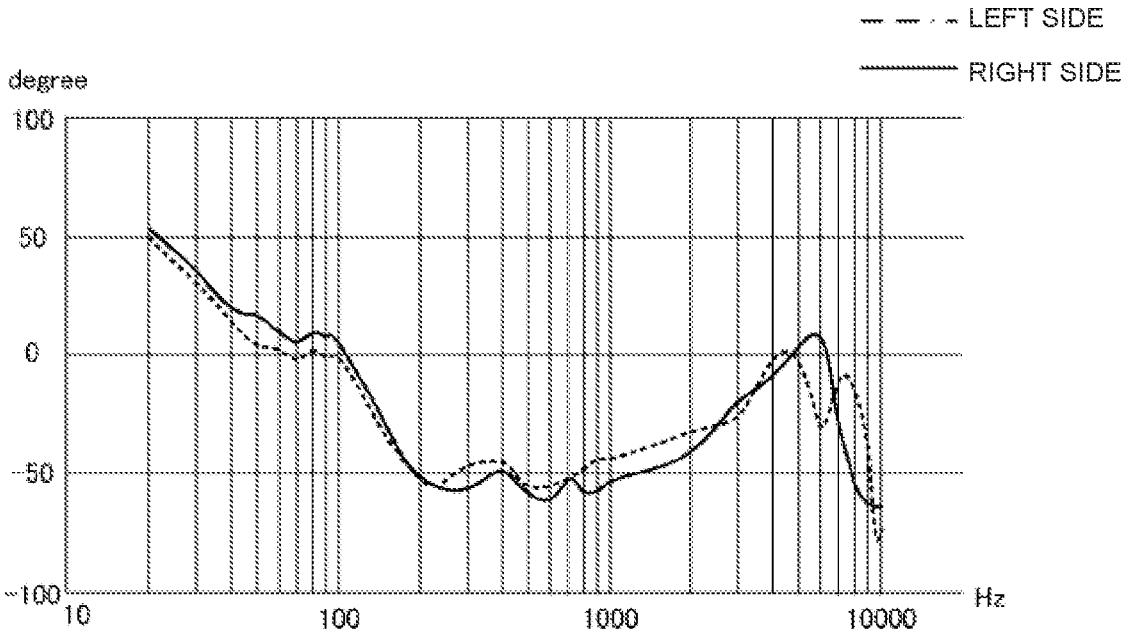
FIG. 4B is an explanatory diagram showing one example of phase characteristics of the headphones provided with the sound absorber.

FIG. 4A is an explanatory diagram showing an example of the phase characteristics of the left-side headphone unit and the right-side headphone unit of the reference example in which the sound absorber 70 is not provided. FIG. 4B is an explanatory diagram showing an example of the phase characteristics of the left-side headphone unit 11 and the right-side headphone unit 12 of the present embodiment provided with the sound absorber 70.

As shown in FIG. 4A, in the reference headphones, reflections and interference of the output sound of the speaker unit 5 between the baffle plate 3 and the ear pad 7 occur in the midrange of approximately 300 Hz to 2 kHz and causes phase delays of up to about 80°.

In the headphones 1 of the present embodiment, on the other hand, the phase delay is improved to about 60° in the midrange of approximately 300 Hz to 2 kHz, as shown in FIG. 4B. In contrast, by the gap 73 between the opening 71 and the ear pad 7, the sound absorber 70 of the present embodiment does not obstruct the resonance sound output from the first port 32, so that the midrange phase characteristics are also not deteriorated.

Thus, the phase characteristics of the headphones 1 of the present embodiment are improved by the sound absorber 70, and the effect of the ANC function is also improved.

The second port 41 of the chamber 4 is not limited to the embodiment example described above. The second port 41 can be provided on either the bottom wall 40 or the side wall of the chamber 4.

Modification

Figure 5:
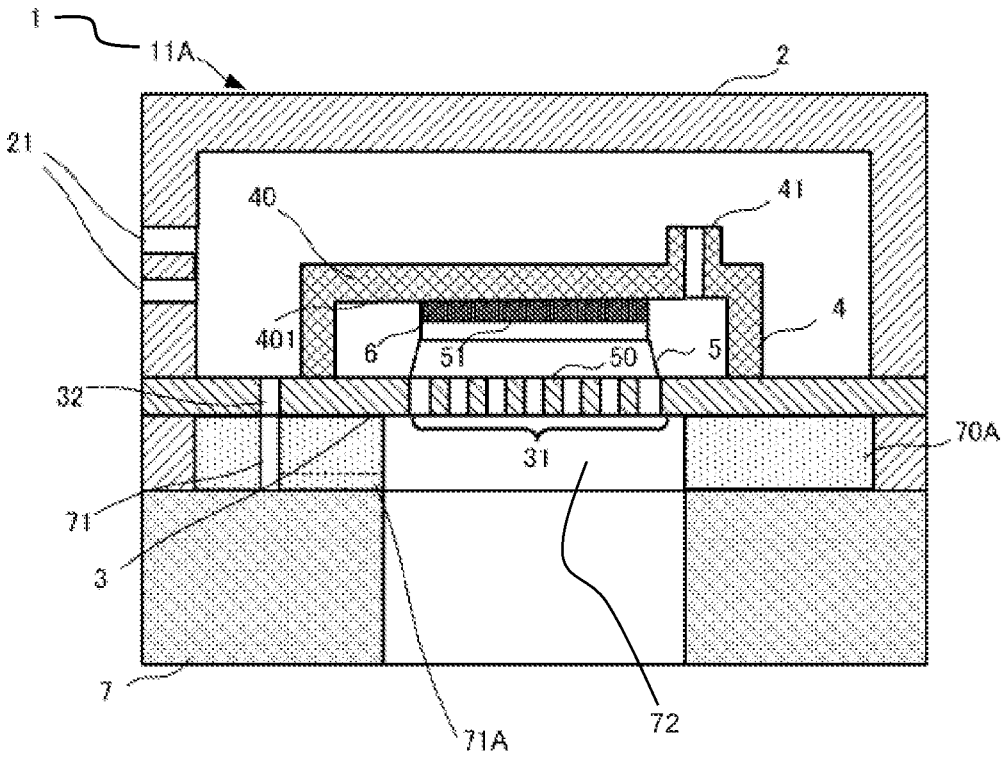
FIG. 5 is a cross-sectional view of a headphone unit according to a modification.
Figure 6:
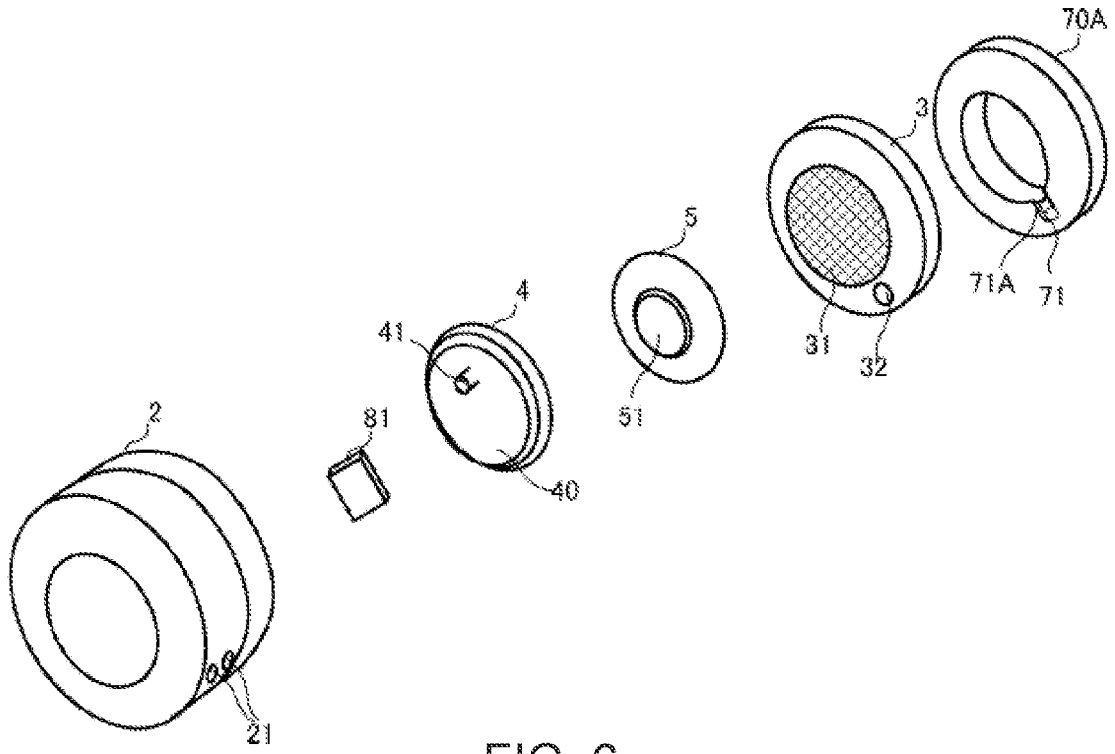
FIG. 6 is a partially exploded perspective view of the headphone unit according to the modification.

The headphones 1 according to a modification will be described with reference to FIG. 5. FIG. 5 is a cross-sectional view of a left-side headphone unit 11A according to the modification. FIG. 6 is a partially exploded perspective view of the left-side headphone unit 11A according to the modification. Components that are identical to those of the embodiment described above have been assigned the same reference symbols, and their descriptions have been omitted. Since the left-side headphone unit 11A and the right-side headphone unit 12A of the modification have the same structure, only the left-side headphone unit 11A will be shown in this modification.

The headphones 1 of the modification are different from the embodiment described above in that a sound absorber 70A is included. The thickness of the sound absorber 70A is partially the same as the distance between the baffle plate 3 and the ear pad 7. Instead of the gap 73 of the embodiment described above, the sound absorber 71 and the ear pad 7 are partially spaced apart from each other with a groove 71A as a gap therebetween. More specifically, the sound absorber 70A has, as the gap, the groove 71A formed from a position facing the first port 32 to a position facing toward the speaker unit 5, and the groove 71 connects the opening 71 and the central opening 72 (portion facing the sound-emitting part 50).

That is, the sound absorber 70A fills almost all of the space between the baffle plate 3 and the ear pad 7, but is provided with the groove 71A as a gap for allowing the resonance sound output from the first port 32 to reach the ear of the user.

The cross sectional area of the groove 71A is preferably greater than the cross sectional area of the first port 32. By making the cross sectional area of the groove 71A greater than the cross sectional area of the first port 32, the groove 71A can be prevented from functioning as a bass reflex port, and the desired sound quality can be reproduced. The cross-sectional shape of the groove 71A can be any shape, such as circular, elliptical, or polygonal.

The description of the present embodiment is exemplary in all respects and should not be considered restrictive. The scope of this disclosure is indicated by the Claims section, and not the embodiment described above. Furthermore, the scope of this disclosure is intended to include all modifications within the meaning and scope equivalent to that of the claims.

What is claimed is:

1. Headphones comprising:

a speaker unit;

a baffle plate that fixes the speaker unit, the baffle plate including a bass reflex port disposed therein;

an ear pad disposed facing toward the baffle plate; and a sound absorber positioned between the baffle plate and the ear pad, the sound absorber being made up of porous material, the sound absorber having an unobstructed hole that penetrates completely and straight through the sound absorber, that faces the bass reflex port, and that has a diameter which is equal to or larger than a diameter of the bass reflex port.

2. The headphones according to claim 1, wherein the sound absorber and the ear pad are at least partially spaced apart from each other with a gap therebetween.

3. The headphones according to claim 2, wherein the gap has a thickness that is greater than the diameter of the bass reflex port.

4. The headphones according to claim 3, wherein the gap is a groove formed from a position facing the bass reflex port to a position facing toward the speaker unit.

5. The headphones according to claim 4, wherein the sound absorber includes an opening at a position facing toward the speaker unit.

6. The headphones according to claim 3, wherein the sound absorber includes an opening at a position facing toward the speaker unit.

7. The headphones according to claim 2, wherein the gap is a groove formed from a position facing the bass reflex port to a position facing toward the speaker unit.

8. The headphones according to claim 7, wherein the sound absorber includes an opening at a position facing toward the speaker unit.

9. The headphones according to claim 2, wherein the sound absorber includes an opening at a position facing toward the speaker unit.

10. The headphones according to claim 1, wherein the sound absorber includes an opening at a position facing toward the speaker unit.

11. The headphones according to claim 1, wherein the speaker unit has an active noise cancelling function.

* * * * *